United States Patent [19]

Stern

[11] 4,040,354

[45] Aug. 9, 1977

[54] GRAVITY-DEPLOYED DOUBLE-ENDED ANTI-TANK MINE

[75] Inventor: Allen E. Stern, Morristown, N.J.

[73] Assignee: The United States of America as represented by the Secretary of the Army, Washington, D.C.

[21] Appl. No.: 627,174

[22] Filed: Oct. 30, 1975

[51] Int. Cl.[2] ..... F42B 21/00; F42B 23/26; F42B 1/02; F42B 11/22

[52] U.S. Cl. ..... 102/8; 102/19.2; 102/24 HC; 102/70.2 R; 102/56 SC

[58] Field of Search ..... 102/8, 19.2, 24 HC, 102/56 SC, 70.2 R; 200/225, 233, 235, 240, 241

[56] References Cited

U.S. PATENT DOCUMENTS

| | | | |
|---|---|---|---|
| 2,411,788 | 11/1946 | Hammond | 102/70.2 R |
| 2,706,949 | 4/1955 | Icessenich | 102/24 HC |
| 2,863,014 | 12/1958 | Deer | 200/225 |
| 3,086,468 | 4/1963 | Mountjoy | 102/70.2 R |
| 3,088,014 | 4/1963 | Stewart | 200/225 |
| 3,158,705 | 11/1964 | Bliss | 102/70.2 R |
| 3,292,536 | 12/1966 | Church | 102/24 HC |
| 3,495,532 | 2/1970 | Roberts | 102/24 HC |
| 3,557,697 | 1/1971 | Joyner | 102/2 |
| 3,875,862 | 4/1975 | Fischer | 102/56 SC |
| 3,956,988 | 5/1976 | Pecksen | 102/24 HC |

FOREIGN PATENT DOCUMENTS

| | | | |
|---|---|---|---|
| 2,067,683 | 10/1969 | France | 102/56 SC |
| 2,071,271 | 9/1971 | France | 102/8 |
| 14,928 | 9/1892 | United Kingdom | 200/226 |

*Primary Examiner*—Samuel W. Engle
*Assistant Examiner*—Donald P. Walsh
*Attorney, Agent, or Firm*—Nathan Edelberg; A. Victor Erkkila; Thomas R. Webb

[57] ABSTRACT

A double-ended, high-explosive, anti-tank mine, adapted to be carried into the air, in a projectile, for example, ejected, deployed and come to rest on either end, comprises a housing having a short cylindrical side wall and two end walls removably attached to the side wall, an annular main charge of high explosive material having concave end surfaces lined with hardened metal missile plates, a clearing charge of propellant located between the main charge and each end wall, a tubular booster charge mounted within the annular main charge, and a fuze mounted in the housing and comprising a conventional proximity fuze for sensing the presence of a tank and producing a firing signal, a firing circuit including a gravity-controlled liquid mercury switch having at least three electrodes, and a battery connected to the two clearing charges in such manner that the upper clearing charge is initiated in response to the firing signal, prior to initiation of the main charge.

7 Claims, 3 Drawing Figures

GRAVITY-DEPLOYED DOUBLE-ENDED ANTI-TANK MINE

GOVERNMENTAL INTEREST

The invention described herein may be manufactured, used and licensed by or for the Government for Governmental purposes without the payment to me of any royalty thereon.

BACKGROUND AND SUMMARY OF THE INVENTION

The present inventions relates to an improved, high-explosive, anti-tank land mine containing a plurality of explosive charges, and fuze means for initiating the charges in a particular sequence, in response to a signal produced by the presence of a tank or other armored vehicle.

Bearce U.S. Pat. No. 3,216,354, granted Nov. 9, 1965, disclosed a land mine, intended to be placed underground, including a cylindrical housing containing a main high explosive shaped main charge having a lower flat surface and an upper dish-shaped surface which is lined with a metal plate or cover member of frangible or malleable material. An auxiliary clearing charge is carried by a removable top plate of the housing (above the shaped charge) together with a primer and an impact fuze mechanism adapted to be actuated by a vehicle to actuate the primer to initiate the clearing charge. Explosion of the clearing charge (1) blows the overburden and the top plate off the housing to expose the shaped charge and (2) actuates a firing mechanism which initiates a delay charge which, after a predetermined time interval, initiates the shaped charge.

An object of the present invention is to provide a new and improved high-explosive anti-tank, land mine.

In accordance with the present invention, the land mine of the Bearce patent is modified and improved by (1) substituting a hardened metal plate for the frangible or malleable liner of Bearce, to function as a hypervelocity projectile; (2) making the mine double-ended, with a concave surface on each end of the main charge lined with a hardened metal plate, a removable end plate or wall at each end of the housing, and a clearing charge at each end between the main charge and the end wall, whereby the mine can be carried into the air, e.g. by an artillery projectile, ejected over the target area, deployed and come to rest by gravity on either end, instead of being placed underground; and (3) providing the mine with means including a gravity-controlled switch for initiating the upper clearing charge only, thereby removing the upper end wall only and exposing the upper end of the main charge, in response to a firing signal, e.g. derived from a proximity fuze, prior to initiation of the main charge. The gravity-controlled switch may, for example, be a liquid mercury switch having at least three electrodes.

DETAILED DESCRIPTION OF A PREFERRED EMBODIMENT

Figure 1:
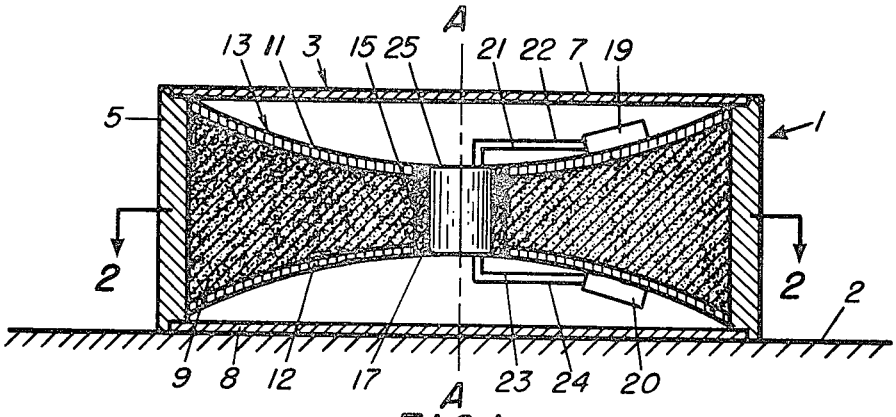
FIG. 1 is an axial section view, taken on line 1–1 of FIG. 2, of a land mine embodying the present invention.
Figure 2:
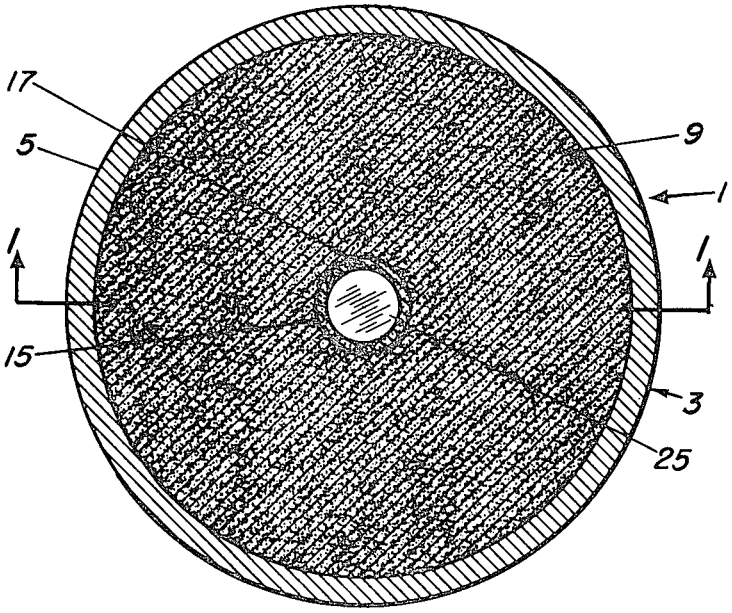
FIG. 2 is a transverse section view, taken on line 2—2 of FIG. 1.

FIGS. 1 and 2 show a generally symmetrical, double-ended, high explosive, anti-tank mine 1 capable of being deployed from the air and come to rest on the ground 2 by gravity on either end and producing an explosively launched projectile or missile from the upper end by selective initiation. The mine has an external housing 3, which includes a short cylindrical side wall 5 and two flat circular end walls or plates 7 and 8, on either of which the mine may come to rest, removably attached to the side wall 5. A typical housing would be about 5 inches in diameter and about 2.3 inches long.The diameter should be at least twice the length of minimize resting on the side. An annular charge 9 of high explosive material, such as pressed PBX, is fixed within the housing 3, as by casting, facing the end plates 7 and 8. The two ends of charge 9a, are dish-shaped or concave and lined with two similarly-shaped hardened metal annular plates 11 and 12, to form (with the charge) a double-ended Misnay-Schardin, or "plate", charge 13. The central opening 15 of the charge 9 is preferably lined with a tubular booster charge 17 of intermediate high explosive material capable of initiating the main charge 9.

Two clearing charges 19 and 20 of low explosive propellant are mounted, one at each end of the mine, in the end spaces 20 between the plates 11 and 12 and the end walls 7 and 8, for removing the upper end wall and exposing the upper plate of the mine. Each of the clearing charges 19 and 20 is adapted to be initiated electrically, and is connected by two conductors 21–22 and 23–24 to a fuze 25, which may be located within the booster charge 17. Parts of the fuze 25 may be located in the end spaces 20. The fuze 25 includes a gravity controlled switch, such as a liquid mercury switch 27 shown in FIG. 3, for selectively initiating the particular clearing charge that is at the top of the mine when the latter comes to rest, that is, the "upper" clearing charge.

Figure 3:
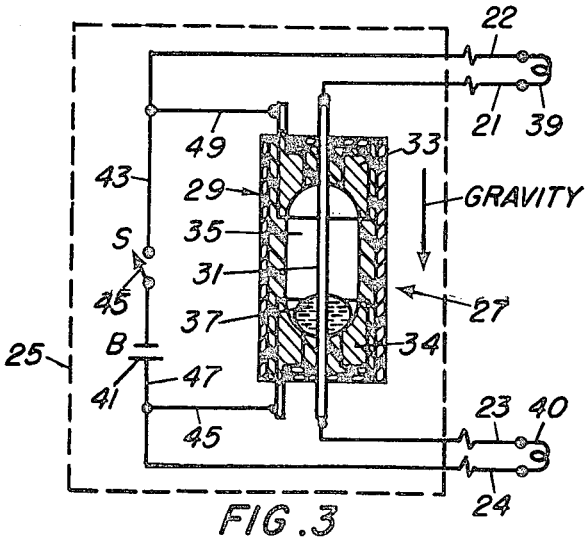
FIG. 3 is a fuze circuit diagram including a longitudinal section view of a liquid mercury switch.

The switch 27 shown as an example in FIG. 3 is identical to the mercury switch disclosed in Stewart U.S. Pat. No. 3,088,014, granted Apr. 30, 1963, and comprises an insulating housing 29 containing an elongated central electrode 31 and two annular end electrodes 33 forming an elongated space 35, containing a mercury globule 37. The switch 27 is oriented in the mine 1 parallel to the central axis A-A, so that when the mine comes to rest on the end plate 8, the mercury globule 37 will fall to the lower end of space 35 and connect electrodes 31 and 34 as shown in FIG. 3. The electric squib 39 of the upper clearing charge 19 is connected to a battery 41, by conductor 22, conductor 43 and a signal switch 45, and by conductor 21, central electrode 31, mercury globule 37, lower annular electrode 34 and conductors 45 and 47. At the same time, squib 40 of the lower clearing charge 20 is short-circuited by conductors 23, 24 and 45, electrodes 31 and 34 and the mercury globule 37. If the positions of the mine and switch were reversed, the squib 40 of clearing charge 20 would be connected to the battery 41 by conductors 24 and 47, and by conductor 23, central conductor 31, mercury globule 37, annular conductor 33, conductors 49 and 43, and switch 45. Therefore, closing of the switch 45, after the mine has come to rest on either end, automatically initiates the clearing charge that is at the top of the mine, thus removing the upper end plate, and any overburden if the mine has buried itself in soft earth, and exposing the upper plate charge.

The switch 45 may be actuated by a signal obtained by a conventional tank-sensing device, (not shown) such as the magnetometer of Odom et al. U.S. Pat. No. 3,239,754, dated Mar. 8, 1966, forming part of the fuze 25. The battery 41 and switch 45 may be replaced by a signal voltage obtained from the tank-sensing device. The fuze 25 also includes conventional means including a delay element and one or more firing trains (not shown) for initiating the booster charge 17 at a predetermined time after initiation of the upper clearing charge, to initiate the main charge 9 and explosively project the upper metal plate as a hypervelocity missile capable of penetrating several inches of armor, or severing the track of a tank. The total weight of a 5 inches x 2.3 inches mine, as described above, would be only about 5 to 7 pounds.

If the middle portion of the central electrode 31 in FIG. 3 were removed, to make a four electrode switch, it would be necessary to connect conductor 21 to the lower electrode 31, and conductor 23 to the upper electrode 31, to produce the same results.

The present invention is incorporated into a similar double-ended mine having a clearing charge at each end and a mechanical gravity-controlled switch for initiating the upper clearing charge only, disclosed and claimed in an application for Ferdinando V. Dukic (Ser. No. 627,175) filed concurrently herewith, assigned to the same assignee.

The invention is also incorporated into a similar double-ended mine having a clearing charge at each end, and fuze means, responsive to a firing signal, for simultaneously (1) initiating a fast firing train to initiate the upper clearing charge only, and (2) starting a slow firing train including a delay element to initiate the main charge after a predetermined time, disclosed and claimed in an application of Norman Regber, Ferdinando V. Dukic, and Frank Diorio (Ser. No. 627,176), filed concurrently herewith.

What is claimed is:

1. A high-explosive, anti-tank land mine comprising a hollow external connecting wall, two opposite, substantially-flat, circular, end walls attached to the ends of said hollow external connecting wall, said mine being adapted to be deployed from the air and come to rest by gravity on either end wall thereof; a charge of high explosive material fixed within said hollow external connecting wall, said charge having two concave end surfaces facing said end walls, each surface lined with a concave hardened metal plate thereby forming two oppositely directed double-ended plates; and fuze means disposed within said hollow external connecting wall for initiating said charge after said mine has come to rest on one of said end walls, to explosively project the upper metal plate.

2. A mine as in claim 1, wherein said external connecting wall is a hollow cylindrical wall having a diameter-to-length ratio of at least 2.

3. A mine as in claim 1, wherein said explosive charge is annular and said fuze means is disposed at least partly within a central opening in said charge.

4. A mine as in claim 3, further comprising a hollow cylindrical booster charge disposed between said fuze and said annular charge.

5. A mine as in claim 1, further comprising:

a clearing charge of low explosive propellant disposed at each end of said mine, between each plate and the adjacent end wall; and means, forming part of said fuze means and connected to said clearing charges, for initiating the upper clearing charge only in response to a firing signal after said mine has come to rest on one of said walls but prior to the initiation of the first-named charge, to explosively remove the adjacent upper end wall from said hollow external connecting wall and thereby expose the adjacent surface of said upper plate.

6. A mine as in claim 5, wherein said means includes a gravity-controlled switch separately connected to said clearing charges and responsive to said firing signal.

7. A mine as in claim 6, wherein said clearing charges are electrically initiated, and said gravity-controlled switch is a mercury switch having at least three separate electrodes.

* * * * *